United States Patent [19]

Miller

[11] 4,211,554

[45] * Jul. 8, 1980

[54] METHOD OF INTRODUCING ADDITION AGENTS INTO A VESSEL OF MOLTEN METAL

[75] Inventor: Eldon D. Miller, Zelienople, Pa.

[73] Assignee: Lava Crucible Refractories, Co., Pittsburgh, Pa.

[ * ] Notice: The portion of the term of this patent subsequent to Jan. 15, 1997, has been disclaimed.

[21] Appl. No.: 924,079

[22] Filed: Jul. 12, 1978

[51] Int. Cl.[2] ..... C22C 33/08

[52] U.S. Cl. ..... 75/53

[58] Field of Search ..... 75/53–58

[56] References Cited

U.S. PATENT DOCUMENTS

| | | | |
|---|---|---|---|
| 3,915,693 | 10/1975 | Rasmussen | 75/53 |
| 4,088,477 | 5/1978 | Hetke | 75/53 |

*Primary Examiner*—P. D. Rosenberg

*Attorney, Agent, or Firm*—Webb, Burden, Robinson & Webb

[57] ABSTRACT

A method of treating molten metals with addition agents comprising extruding into the lower portion of the vessel a composition comprising a nonalloying and vaporizable metal carrier and the said addition agents.

8 Claims, 1 Drawing Figure

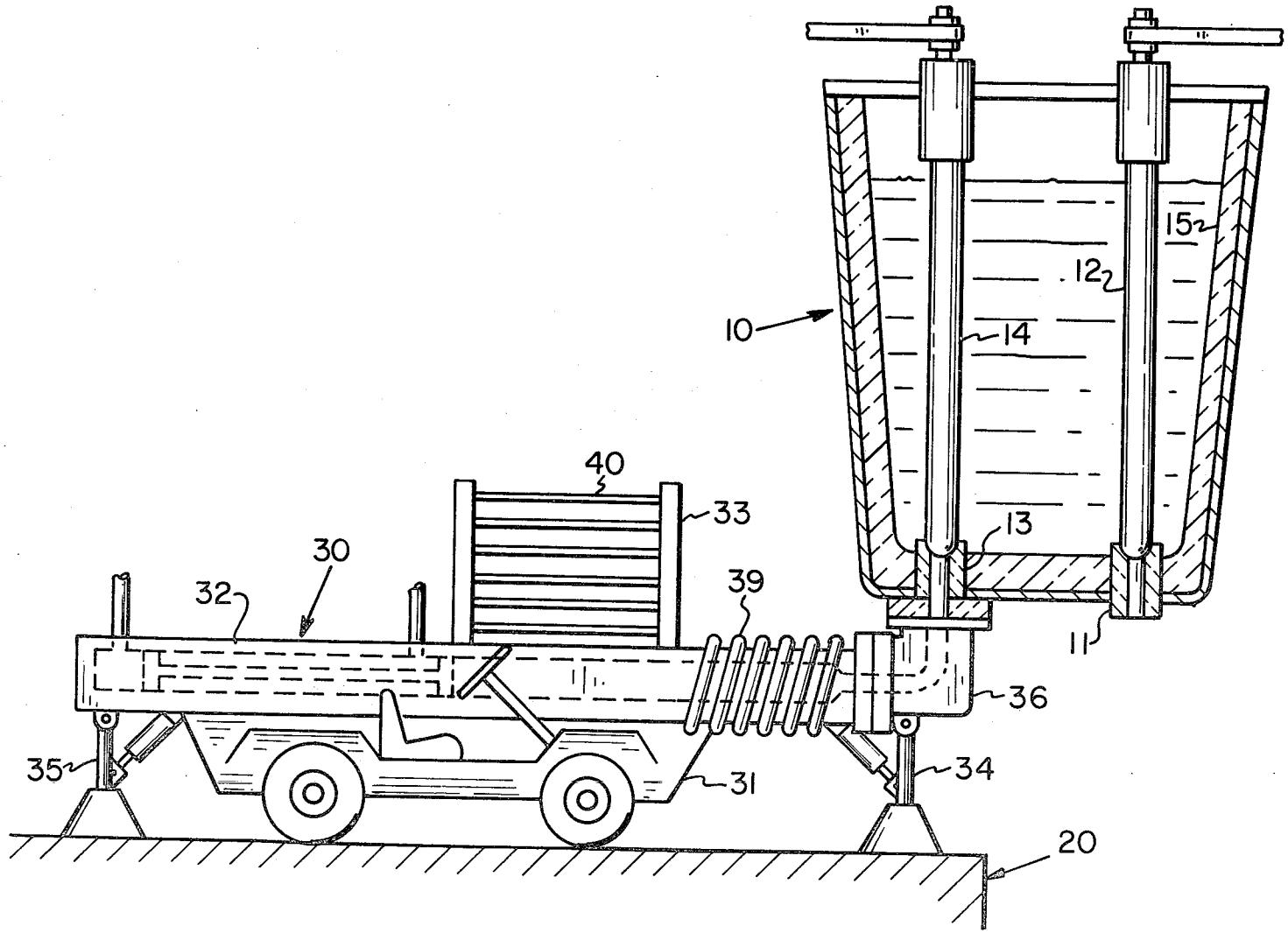
10
11
12
13
14
15
20
30
31
32
33
34
35
36
39
40

METHOD OF INTRODUCING ADDITION AGENTS INTO A VESSEL OF MOLTEN METAL

BACKGROUND

Metallurgy often involves the addition of chemical elements to the molten metal to alter its composition and properties. Some additions are made with the expectation that they will react with other elements in the melt to aid in the removal of said elements. These addition agents may be referred to as deoxidizers and desulfurizers in the case of steelmaking. Other additions are made to alloy the melt and in the case of steelmaking may include ferromanganese, ferrosilicon, ferrochromium, nickel, copper, lead, aluminum to mention but a few.

Addition agents are typically added to the molten bath near the end of the refining process, to the bath in the teeming ladle or to the mold itself.

Introduction of the addition agents to the bath in the refining vessel or teeming ladle (this application does not relate to adding addition agents to the mold) presents a number of problems. Often, the molten metal is covered by a slag layer through which the addition agent must penetrate. The agent has need to be mixed throughout the molten bath and thus requires introduction of the agent deep within the bath. For certain addition agents, for example ferroalloys added to steel, the agent must be preheated to avoid chilling the bath and/or they must be mixed with chemical reagents that cause exothermic reactions. One technique for adding addition agents comprises providing a wire (of the agent) with a coating and reeling the wire deep into the melt (See, for example, U.S. Pat. Nos. 2,577,837 and 3,729,309). Yet another technique involves the use of an immersion bell or plunger (See, for example, U.S. Pat. Nos. 2,776,206, 3,788,624 and 3,942,775). In still another technique, the addition agent is carried into the bath in a stream of inert gas either though a tube passing through the surface of the melt or through the vessel walls (See, for example, U.S. Pat. Nos. 3,575,695 and 3,980,469). One ancient patent suggests forcing addition agents reduced to a proper degree of fineness through a port in the base of the vessel or ladle (See, for example. U.S. Pat. No. 165,929).

Finally, U.S. Pat. No. 1,938,716 suggests extruding certain metal additives which are soft enough to be extruded into the bottom of a vessel or ladle. It is further taught in the '716 patent that with the extrusion of sodium metal into the molten metal bath. The sodium must be kept below the melting point thereof (100° C.) Because sodium will not react with ingredients of a steelmaking bath at steel making temperatures, sodium will not function as a deoxidizer as suggested. The introduction of sodium can only serve to chill the melt.

It is an advantage according to this invention to provide a method of introducing addition agents to a molten bath which agents are not necessarily soft enough to extrude by mixing the addition agent with an extrudable metal in sufficient quantity such that the mixture can be extruded into the vessel or ladle. It is yet another advantage to extrude an addition agent into the lower portion of the vessel containing a metal comprising first mixing with a nonalloying (with the melt) and vaporizable (at the temperatures of the melt) metal carrier which mixture may be extruded.

BRIEF DESCRIPTION

This invention relates to a method of treating molten metal in particular, ferrous melts. The method comprises a first step of mixing addition agents which are not necessarily extrudable by themselves with an easily extrudable metal. Calcium and calcium alloys are considered easily extrudable metals. A second step comprises heating and extruding the mixture of addition agent and extrudable metal into the lower portion of a vessel containing the molten metal to be treated. Preferably the nonalloying metal carrier comprises a mixture of calcium and 0.5 to 14 percent by weight sodium. The mixture of addition agents and extrudable metal is heated to, say, 400° to 600° C. prior to being extruded into the molten metal. Preferably, the addition agent and the nonalloying metal carrier are blended as particles less than about one-quarter inch in large dimension prior to extruding into the vessel. Still further, it is preferred that the nonalloying metal carrier comprises more than 50 percent by weight of the mixture.

DESCRIPTION OF THE PREFERRED EMBODIMENTS

Further features and other objects and advantages of this invention will become apparent from the following detailed description made with reference to the drawing which is a partial section of apparatus useful in the method of this invention.

Filed of even date herewith is U.S. Patent application Ser. No. 923,952 entitled "System for Introducing Additive Agents into Vessel of Molten Metal" which application discloses apparatus which may be useful in the practice of the herein described method.

According to a preferred embodiment and the best mode now contemplated, a particulate addition agent which is not extrudable is mixed with easily extrudable particulate calcium metal containing a small percentage of sodium metal. The addition agent may, for example, comprise ferrosilicon. The mixture is preferably compacted and still further preferably compacted at temperatures above which sodium melts (i.e., 100° C.). The compacted mixture may be pressed or shaped during compaction into cylindrical cartridges of a convenient size. The cartridges are then placed in a cylinder from which they can be extruded through a die into an additive agent port in the base or near the bottom of a vessel holding the molten metal to be treated. The calcium is present preferably up to fifty percent by weight of the cartridge composition.

Preferably, the cartridge is heated above 400° C. as it is extruded into the molten metal to be treated. As the cartridge is extruded into the molten metal bath it breaks apart, the sodium vaporizes immediately forming bubbles and providing an agitation in the molten metal bath. The calcium melts and dissolves and may react with oxygen and/or sulfur in the bath to remove these elements from the bath. Unreacted calcium may vaporize and emerge through the surface of the bath. The addition agent, e.g. ferrosolicon, melts and mixes with the molten bath to alloy it.

To demonstrate that not easily extrudable addition agents (at the temperature of extrusion under consideration) may be placed in an easily extrudable metal and extruded, several extrusion tests were conducted. The test apparatus maximized extrusion difficulties by using a reduction through the die of five to one with no taper between the extrusion cylinder and the die. The rate at which the billet was extruded into an argon purged atmosphere at a constant pressure (1400 psi) and temperature (460° C.) was taken as the measure of extrudability.

A mixture of one-half percent aluminum filings (the not easily extruded addition agents) and ninety nine and one-half percent calcium metal (easily extrudable metal) was found to extrude at a rate of 0.042 inches per minute. In another example, four percent of the calcium was replaced by four percent sodium metal. The mixture (including the aluminum filings) was found to extrude at a rate of 0.666 inches per minute.

As used in the following claims, the terms "calcium" and "calcium alloy metals" include calcium metal and up to fifty percent by weight of metals selected from the group consisting of magnesium and barium. The calcium and/or calcium metal alloys may comprise impurities so long as they do not adversely affect the composition of the molten metal considering the purposes for which it is to be used after casting.

The following described apparatus may be useful in the practice of the herein described method.

Referring now to the drawing, there is shown a refractory ladle 10, positioned by a crane (not shown) adjacent the pouring platform 20. A movable vehicle 30 is positioned upon the platform in the vicinity of the ladle.

The ladle has a pouring nozzle 11 that is controlled by stopper and stopper rod assembly 12. The ladle has another port which is controlled by a second stopper rod assembly 14. The stopper and rod assemblies are only partially shown as they are well known in the teeming art. The ladle is provided with an appropriate refractory brick lining 15. While stoppers and stopper rod assemblies have been illustrated for simplicity, those skilled in the art will recognize that slide gates are equally suitable means for controlling the pouring nozzle and the addition agent port 13.

The mobile vehicle may have a chassis with front and rear axles thereon for carrying front and rear wheels, for example, pneumatic tires. At least one axle must be steerable. The vehicle has its own motivating system with appropriate drives for moving the vehicle into position near the vessel. The basic function of the vehicle is to carry the cylinder 32 and the associated hydraulics (i.e., motor, reservoir, conduit and controls not shown). Roughly speaking, the cylinder is divided into three functional sections. The back half comprises a double acting hydraulic cylinder. The piston can be completely withdrawn into the back half of the cylinder. The frontmost quarter of the cylinder comprises an extrusion section terminating in an extrusion die, that is, a reduced section. The centermost portion comprises a loading section, i.e., the cylinder is open on one side to permit the loading of the cylinder with cartridges of extrudable additives agents. Over the loading section is a rack 33 for holding the ready to use cartridges 40 of extrudable additives. Hydraulically positionable stands 34 and 35 are arranged to remove the vehicle load from its suspension system after the cylinder has been connected to the additive agent port 13 of the vessel. In some cases, it is desirable to heat the die and the cylinder 32 and for this reason electrical heating coils 39 are shown in FIG. 1.

Before or after the vehicle is positioned with the cylinder engaging the ladle additive agent port, the piston is withdrawn to its rearwardmost position and a cartridge of extrudable additive agent is positioned in the cylinder. Thereafter the piston is brought forward to move the cartridge into the extruding section of the cylinder and is further advanced to extrude additive through the elbow and into the port of the ladle. At this time, the ladle port is unstopped and the piston continuously extrudes the extrudable additive into the base of the vessel through the additive agent port. When the piston reaches its extreme position toward the die end of the cylinder, a short period of time is permitted for the extrudable agent to work its way into the solution in the vicinity of the stopper seat. Thereafter, the stopper is allowed to seal the additive agent port and the piston is returned to its rearwardmost position permitting the introduction of an additional cartridge of extrudable addition agent into the cylinder. The process is repeated until sufficient additive agent has been introduced into the melt. When the addition process is complete, the vehicle is withdrawn from the vessel and the vessel is thereafter (in the case of an open hearth shop of the traditional type) teemed into the ingots adjacent the pouring platform through the teeming nozzle.

Having thus defined the invention with the detail and particularity required by the Patent Laws, what is desired protected by Letters Patent is set forth in the following claims.

I claim:

1. A method of treating molten metal with addition agents in a cup-shaped vessel having a bottom and side walls and lower portion adjacent to and including the bottom comprising steps of introducing molten metal to the vessel, heating a comsumption comprising a mixture of said addition agent and a nonalloying and vaporizable metal carrier to a temperature at which it may be extruded, and extruding the composition through a die into the molten metal in the lower portion of the vessel, the temperature of said molten metal in the vessel being above the temperature at which the metal carrier is vaporizable.

2. A method according to claim 1 wherein the nonalloying metal carrier comprises calcium metal and calcium metal alloys.

3. A method according to claim 1 wherein the nonalloying metal carrier comprises a mixture of calcium and calcium metal alloys and up from about 0.5 to 14 percent by weight sodium.

4. A method according to claim 1 wherein the alloying ingredient and the nonalloying metal carrier are blended as particles less than about one-quarter inch in larger dimension prior to extruding into the vessel.

5. A method according to claim 1 in which the composition is heated during the extrusion step to increase the plasticity of the nonalloying metal carrier.

6. A method according to claim 1 in which the nonalloying metal carrier performs a scavenging function within the melt.

7. A method according to claim 1 in which the nonalloying metal carrier is at least fifty percent of the composition.

8. A method of treating molten steelmaking melts with addition agents in a cup-shaped vessel having a bottom and side walls and lower portion adjacent to and including the bottom comprising steps for introducing the steelmaking melt to the vessel, heating a composition comprising a mixture of said addition agent and a nonalloying metal carrier to a temperature at which it may be extruded, said metal carrier being vaporizable at the temperature of the steelmaking melt in the vessel, and extruding the composition through a die into the steelmaking melt in the lower portion of the vessel.

* * * * *

UNITED STATES PATENT AND TRADEMARK OFFICE

CERTIFICATE OF CORRECTION

PATENT NO. : 4,211,554

DATED : July 8, 1980

INVENTOR(S) : Eldon D. Miller

It is certified that error appears in the above-identified patent and that said Letters Patent are hereby corrected as shown below:

Column 2 Line 60 "ferrosolicon" should read --ferrosilicon--.

Column 3 Line 12 "0.666" should read --.066--.

Claim 1 - Column 4 Line 26 "of" should read --for--.

Claim 1 - Column 4 Line 28 "comsumption" should read --composition--.

Signed and Sealed this

*Sixteenth* Day of *September 1980*

[SEAL]

*Attest:*

SIDNEY A. DIAMOND

*Attesting Officer*

*Commissioner of Patents and Trademarks*